US006300573B1

(12) United States Patent
Horie et al.

(10) Patent No.: US 6,300,573 B1
(45) Date of Patent: Oct. 9, 2001

(54) COMMUNICATION CABLE

(75) Inventors: Yasushi Horie; Kazuo Chiba; Minoru Saito, all of Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 09/612,958

(22) Filed: Jul. 10, 2000

(30) Foreign Application Priority Data

Jul. 12, 1999 (JP) ..... 11-197787
Aug. 31, 1999 (JP) ..... 11-244371

(51) Int. Cl.[7] ..... H01B 11/04
(52) U.S. Cl. ..... 174/113 R; 174/27; 174/113 C
(58) Field of Search ..... 174/27, 113 R, 174/113 C, 131 A, 116

(56) References Cited

U.S. PATENT DOCUMENTS 1,008,370 * 11/1911 Robillot ..... 174/27
3,433,890 * 3/1969 Gabriel et al. ..... 174/27
3,644,659 * 2/1972 Campbell ..... 174/27
5,659,152 * 8/1997 Horie et al. ..... 174/113 R

* cited by examiner

*Primary Examiner*—Chau N. Nguyen
(74) *Attorney, Agent, or Firm*—Oblon, Spivak, McClelland, Maier & Neustadt, P.C.

(57) ABSTRACT

A communication cable is provided that satisfies the requirement of Cat.6 for near-end cross talk wherein the difference between the maximum and minimum values of delay time among the four twisted wire pairs constituting the cable is within 25 ns/100 m. The communication cable is made by entwining four twisted wire pairs (T1), (T2), (T3), (T4) made by twisting pairs of insulated wires made by covering electrically conductive wires by polyolefin thermoplastic resin with each pair being twisted with a twist pitch different from the others (pitch: P1<P2<P3<P4) and the inter-pair interposer (6) made of polyolefin thermoplastic resin, while being entwined with each wire pair, around a central interposer (2) made of polyolefin thermoplastic resin having cross sectional area of S1. Cross sectional area S1 of the central interposer (2) satisfies the relationship of inequality $S1 \geqq [\{4.1\ d/(1+\sqrt{2})\}\cdot 0.35]^2 \times \pi$, while the inter-pair interposer (6) that is entwined with the twisted wire pairs is located at such a position as adjoins the twisted wire pair (T1) having the least pitch P1 and does not adjoin the twisted wire pair (T4) having the largest pitch P4.

16 Claims, 13 Drawing Sheets

PRIOR ART Fig. 1
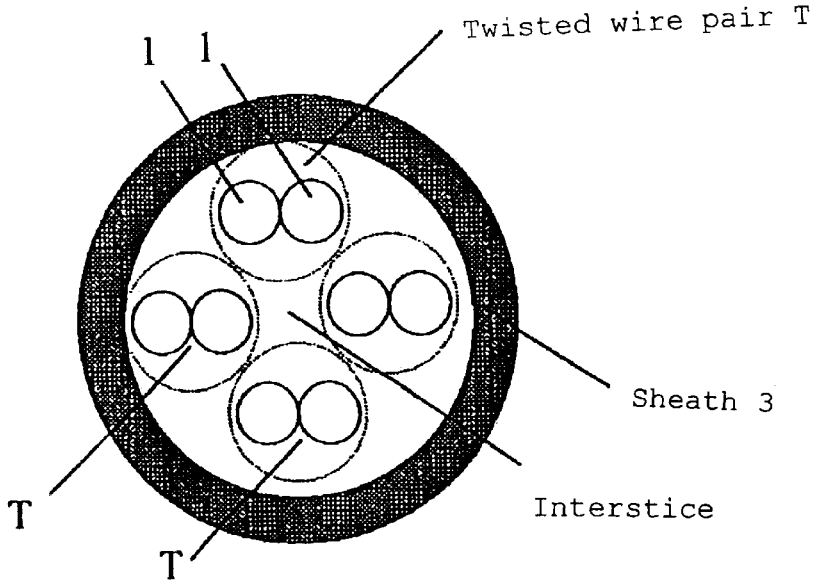
PRIOR ART Fig. 9
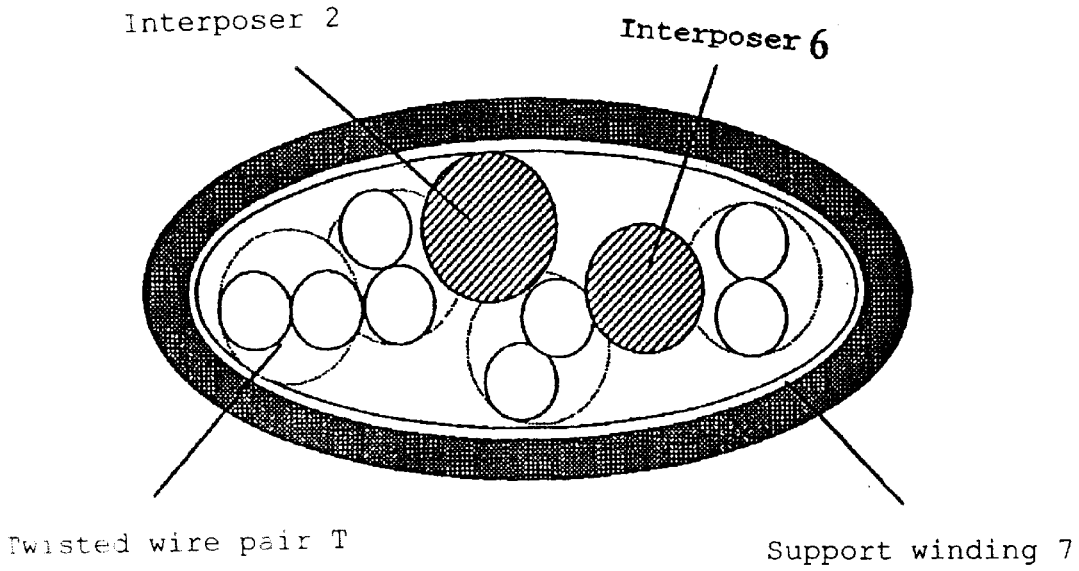

PRIOR ART Fig. 2
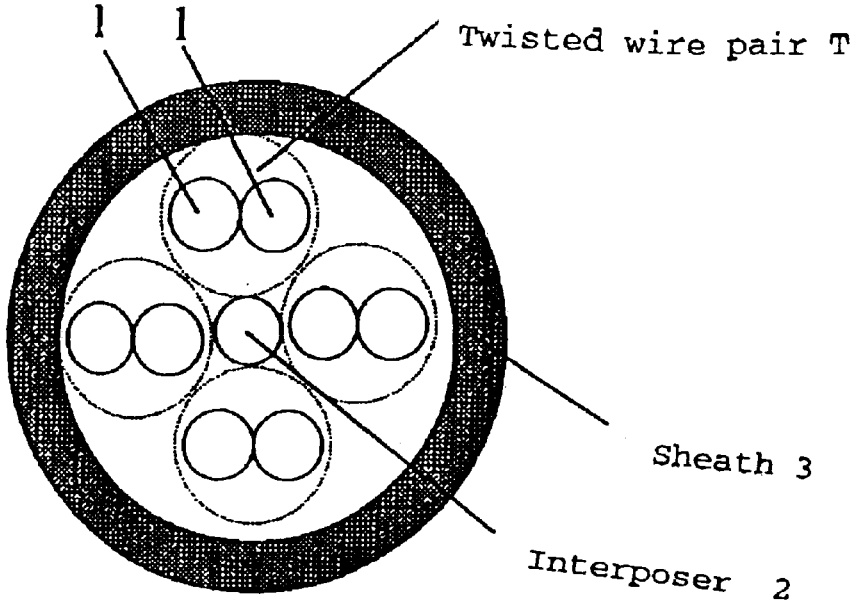
PRIOR ART Fig. 3
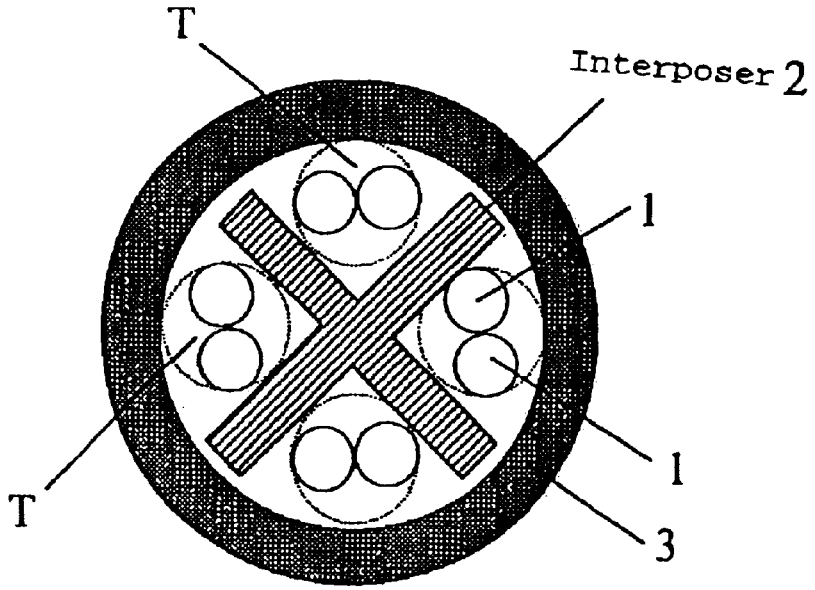

COMMUNICATION CABLE

FIELD OF THE INVENTION

The present invention relates to communication cables of a balanced type used for high-speed transmission in LAN's.

BACKGROUND OF THE INVENTION

A 4-pair cable called a category 5 cable is generally used for high-speed LAN systems with transmission signal speeds up to 100 Mbps. Specification standards for characteristic impedance, near-end cross talk and attenuation of this cable are specified in ISO/IEC and EIA/TIA, so that performance is ensured by conformity to the standard.

Accordingly, conformity to the standard is achieved by differentiating the twist pitches of four twisted wire pairs (T, T, T, T) as shown in FIG. 1, with the difference between the twist pitches being made as large as possible. Each twisted wire pair T is made by twisting a pair of insulated wires 1 each consisting of an electrically conductive wire such as soft copper wire covered by polyolefin thermoplastic resin.

A communication cable is made in a configuration such that a interposer 2 is disposed at the center of the entwined twisted wirepairs (T, T, T, T), as shown FIG. 2, and/or a support winding (not shown) is provided around the entire twisted wire pairs (T, T, T, T) to prevent the twisted condition from loosening, thereby ensuring the geometrical stability of the arrangement of the twisted wire pairs (T, T, T. T). In FIG. 2, reference numeral 3 denotes a sheath made of a thermoplastic resin.

Recently, a technique has been proposed to separate the twisted wire pairs (T, T, T, T) by means of a cross-shaped interposer 2 as shown in FIG. 3.

However, although the requirements of the standards of category 5 can be met sufficiently with the technologies of the prior art, a yet further upgraded cable performance has been proposed for application to the giga-bit Ethernet, which requires a yet further lower level of near-end cross talk. There is also a demand to decrease the difference in the signal propagation delay time between the four pairs of twisted wires. In order to reduce the near-end cross talk in the prior art, twist pitches among the pairs are different. However, this increases the difference in delay time and therefore the two items of target characteristics cannot be satisfied with only this technique.

Performance requirements for cables used for Gbit Ethernet are currently discussed at TIA TR41. Although in a draft state of at present, a category 6 (Cat.6) standard is proposed for UTP (Unshielded Twisted wire Pair) having a transmission capability of up to 250 MHz. On the other hand, Anixter Inc. of the U.S.A. separately specifies a level 7 of performance that is equivalent to Cat.6, for the characteristics of a channel combining a cable and connectors as a specification standard. The category 6 (level 7) standard requires that the attenuation is lower than that of category 5 by 12 dB.

In order to meet the requirements of category 6 and level 7 of Anixter Inc., it is necessary to keep the difference between the maximum and minimum values of delay time among the four twisted wire pairs constituting the cable within 25 ns/100 m. In the case where the twist pitches are differentiated among the twisted wire pairs so that the requirement of Cat.6 for the reduction of near-end cross talk is reliably met with the prior art, the difference in delay time however becomes larger than 25 ns/100 m.

Also it may be considered possible to reduce the cross talk even with such twist pitches that keep the difference in delay time within 25 ns/100 m for the four twisted wire pairs (T, T, T, T) (insulated wires with an outer diameter of insulation in a range from 0.92 to 0.96 mm twisted with pitches from 10 mm to 18 mm, based on experience), by separating the twisted wire pairs with the cross-shaped interposer 2 as shown in FIG. 3. In order to meet the requirement for reducing the near-end cross talk proposed by the Cat.6 draft with a sufficient margin, it is necessary to separate the twisted wire pairs with a sufficiently large space by means of the cross-shaped interposer that has a sufficient thickness, thus resulting in a sturdy cable structure where arrangement of the four twisted wire pairs (T, T, T, T) can be firmly maintained. However, it is difficult to insert the cable covered by the sheath 3, while keeping the cable flat, into a modular plug 4 to have the cable 5 held by the modular plug 4 with a sufficient force, as shown in FIG. 4, because the cable including the cross-shaped interposer cannot be easily flattened and is difficult to insert into the modular plug 4.

OBJECT AND SUMMARY THE INVENTION

The present invention has been made to solve the problems of the prior art described above, and a first object thereof is to satisfy the requirement of Anixter Inc. for the difference in propagation delay time with a sufficient margin for the Cat.6 standard of the near-end cross talk characteristic so that the difference in the signal propagation delay time among the four twisted wire pairs (T, T, T, T) is made as small as possible and the delay time is kept within 25 ns/100 m. A second object of the present invention is to improve the workability of the cable terminal and make such a cable structure that can be easily flattened so that the cable covered with the sheath can be inserted up to just before the insulated wire guide of the modular plug.

In order to achieve the object described above, the present invention provides a communication cable having such a constitution as described below. The communication cable according one aspect of the present invention comprises a central interposer having a cross sectional area of S1, four twisted wire pairs T1, T2, T3, T4 made by twisting the pairs of electrically conductive wires covered by an insulating material, each pair being twisted with a twist pitch different from the others, and one or more inter-pair interposer, wherein the four twisted wire pairs and the inter-pair interposer are disposed around the central interposer while being entwined with each other. Denoting the pitch of the twisted wire pair T1 as P1, the pitch of the twisted wire pair T2 as P2, the pitch of the twisted wire pair T3 as P3 and the pitch of the twisted wire pair T4 as P4, a relationship of inequality P1<P2<P3<P4 is satisfied. When the diameter of the insulated wire that constitutes the twisted wire pair is d, cross sectional area S1 of the central interposer satisfies the following relationship of inequality.

$$S1 \geqq [\{4.1\ d/(1+\sqrt{2})\}\cdot 0.35]^2 \times \pi$$

The inter-pair interposer that is entwined with the twisted wire pair is located at such a position as to adjoin the twisted wire pair T1 that has the least pitch P1 with a specific dielectric constant that decreases the propagation delay time of the adjoining twisted wire pair, and does not adjoin the twisted wire pair T4 that has the largest pitch P4.

In one form of the present invention, the central interposer, the inter-pair interposer and the insulator of the insulated wires are all made of polyolefin thermoplastic resin.

The central interposer and the inter-pair interposer are made of a thermoplastic resin in a rod-like shape, while the central interposer has a circular cross section.

The communication cable according to another aspect of the present invention comprises a central interposer having cross sectional area of S1, four twisted wire pairs T1, T2, T3, T4 made by twisting pairs of electrically conductive wires covered by an insulating material, each pair being twisted with a twist pitch different from the others, and two inter-pair interposers, first inter-pair interposer Q1 and second inter-pair interposer Q2, wherein the four twisted wire pairs and the two inter-pair interposers are disposed around the central interposer while being entwined with each other. Denoting the pitch of the twisted wire pair T1 as P1, the pitch of the twisted wire pair T2 as P2, the pitch of the twisted wire pair T3 as P3 and the pitch of the twisted wire pair T4 as P4, the relationship of inequality P1<P2<P3<P4 is satisfied. When the diameter of the insulated wire that constitutes the twisted wire pair is d, the cross sectional area S1 of the central interposer satisfies the following relationship of inequality.

$$S1 \geqq [\{4.1\ d/(1+\sqrt{2})\}\cdot 0.35]^2 \times \pi$$

The inter-pair interposer Q1 is located to adjoin the twisted wire pair T1 having the least pitch P1 with a specific dielectric constant that decreases the propagation delay time of the adjoining twisted wire pair. The second inter-pair interposer Q2 is located to adjoin the twisted wire pair T4 having the largest pitch P4 with a specific dielectric constant that increases the propagation delay time of the adjoining twisted wire pair. The twisted wire pair T1 having the least pitch P1 is located at a position that does not adjoin the twisted wire pair T4 having the largest pitch P4 and the second inter-pair interposer Q2. The twisted wire pair T4 having the largest pitch P4 is located at a position that does not adjoin the twisted wire pair T1 having the least pitch P1 and the first inter-pair interposer Q1.

Preferably the twisted wire pair T1, the first inter-pair interposer Q1, the twisted wire pair T2, the twisted wire pair T4, the second inter-pair interposer Q2 and the twisted wire pair T3 are disposed around the central interposer in this order, with a set of the twisted wire pair T1 and the twisted wire pair T3 and a set of the twisted wire pair T2 and the twisted wire pair T4 being entwined with each other while being separated from each other by the inter-pair interposers Q1, Q2.

In a preferable form, the central interposer is made of a polyolefin thermoplastic resin, the twisted wire pairs T1 through T4 are each constituted from a twisted pair of insulated wires, each consisting of an electrically conductive wire such as a soft copper wire covered by polyolefin thermoplastic resin, the first inter-pair interposer Q1 is made of polyolefin thermoplastic resin, and the second inter-pair interposer Q2 is made of polyolefin thermoplastic resin including a metal hydrate or made of polyvinyl chloride. The central interposer has a generally circular cross section.

The present invention also provides a multiple-pair communication cable comprising a plurality of communication cables having the constitution described above.

The communication cable according to the present invention comprises a central interposer that is made of polyolefin thermoplastic resin and has cross sectional area of S1, four twisted wire pairs T1, T2, T3, T4 (pitches: P1<P2<P3<P4) made by twisting four pairs of electrically conductive wires such as soft copper wires covered by polyolefin thermoplastic resin, each pair being twisted with a twist pitch different from the others, and one or more inter-pair interposers made of polyolefin thermoplastic resin and disposed between the twisted wire pairs, wherein the four twisted wire pairs and the inter-pair interposer are disposed around the central interposer while being entwined with each other. Cross sectional area S1 of the central interposer satisfies the following relationship of inequality.

$$S1 \geqq [\{4.1\ d/(1+\sqrt{2})\}\cdot 0.35]^2 \times \pi$$

The inter-pair interposer that is entwined with the twisted wire pairs is located at such a position as adjoins the twisted wire pair T1 having the least pitch P1 and does not adjoin the twisted wire pair T4 having the largest pitch P4. This arrangement has excellent effects such as decreasing the near-end cross talk with a difference in delay time not larger than 25 ns/100 m for any combination of the pairs, and providing good workability of the cable terminal.

The communication cable according to another form of the present invention comprises a central interposer made of polyolefin thermoplastic resin having cross sectional area of S1, four twisted wire pairs T1, T2, T3, T4 (pitches: P1<P2<P3<P4) made by twisting four pairs of electrically conductive wires such as soft copper wires insulated by covering with polyolefin in thermoplastic resin, each pair being twisted with a twist pitch different from the others, and two inter-pair interposers made of a thermoplastic resin and disposed between the twisted wire pairs, wherein the four twisted wire pairs and the inter-pair interposers are disposed around the central interposer while being entwined with each other. Cross sectional area S1 of the central interposer satisfies the following relationship of inequality.

$$S1 \geqq [\{4.1\ d/(1+\sqrt{2})\}\cdot 0.35]^2 \times \pi$$

The inter-pair interposers that are entwined with the twisted wire pairs are located at positions to separate the twisted wire pair from each other. This arrangement has excellent effects such as decreasing the near-end cross talk with the difference in delay time not larger than 25 ns/100 m for any combination of the pairs, and providing good workability of the cable terminal.

The excellent effect of decreasing the near-end cross talk can also be achieved even with a multiple-pair communication cable consisting of a larger number of pairs made by assembling a plurality of the communication cables described above.

BRIEF DESCRIPTION OF THE DRAWINGS

Exemplary embodiments of the invention will now be described in conjunction with the drawings in which:

FIG. 1 is a sectional view showing an example of communication cable of the prior art.

FIG. 2 is a sectional view showing another example of communication cable of the prior art.

FIG. 3 is a sectional view showing further another example of communication cable of the prior art.

FIG. 9 is a sectional view showing an example of a flattened end of the communication cable of the prior art.

DETAILED DESCRIPTION OF THE PREFERRED EMBODIMENTS

When the four twisted wire pairs are disposed around the central interposer having the cross sectional area S1, the four twisted wire pairs cannot be disposed without clearance therebetween. In order to fill the clearance, the inter-pair interposer made of polyolefin thermoplastic resin is entwined together with the twisted wire pairs. At this time, in an embodiment of the first form, the inter-pair interposer is filled to adjoin the twisted wire pair T1 having the least pitch P1 while not adjoining the twisted wire pair T4 having the largest pitch P4. In an embodiment of the second form, the first inter-pair interposer Q1 is filled so as to adjoin the twisted wire pair T1 having the least pitch P1, while the second inter-pair interposer Q2 is disposed so as to adjoin the twisted wire pair T4 having the largest pitch P4.

The reason for setting the limit described above for the value of cross sectional area S1 of the central interposer will be described in detail below. The filling interposer (central interposer) is usually used to prevent the twisted wire pairs from breaking the predetermined arrangement, and is inserted into an interstice generated at the center when the twisted wire pairs are entwined, with substantially the same cross sectional area.

The cross sectional area of the central interposer is calculated as follows in the case of the 4-pair cable (a cable consisting of four twisted wire pairs) as in the present invention.

Figure 4:
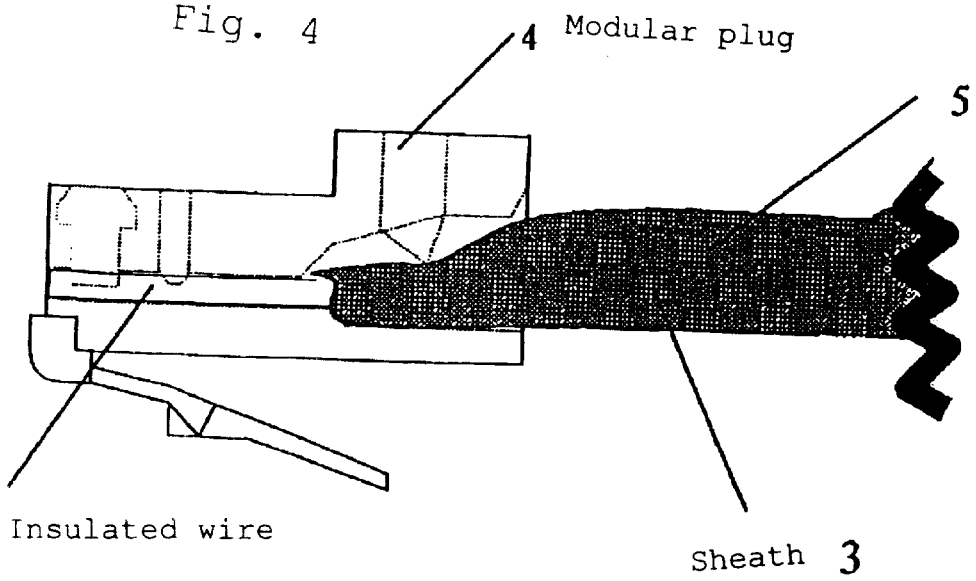
FIG. 4 is a drawing explaining a case of attaching a communication cable to a modular plug.
Figure 5:
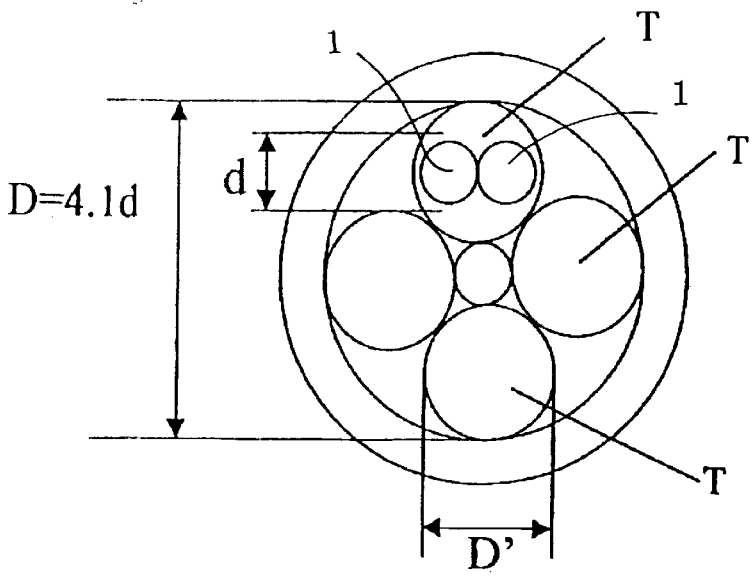
FIG. 5 is a drawing explaining a procedure to derive a relationship of inequality used in the present invention.

The inter-space twisted outer diameter D of four twisted wire pairs (T, T, T, T) entwined with each other to constitute the cable as shown in FIG. 5 is given from experience as D=4.1 d, with d representing the outer diameter of the insulated wire 1. When the four twisted wire pairs (T, T, T, T) are regarded as four single-core wires, outer diameter D' of the single-core wire is calculated as $D'=4.1\ d/(1+\sqrt{2})$.

Thus the cross sectional area Smin of the interstice that must be filled is given as the circular portion having a diameter of 4.1 d−2D'. When a filler having a cross sectional area equal to the sectional area Smin of this circle is inserted as the central interposer, the four twisted wire pairs are disposed in such an arrangement that they do not overlap each other and excessive space is not generated therebetween.

It is expected that, by inserting the central interposer having a cross sectional area larger than Smin, a clearance is generated between the twisted wire pairs (T, T, T, T) and therefore greater effect of improving the cross talk would be achieved. Thus an examination was conducted to gradually increase the cross sectional area of the central interposer, and it was confirmed that the requirement of the Cat.6 standard for cross talk can be satisfied reliably by inserting in the center a interposer having such a cross sectional area that results in a configuration of five or more circles of equivalent diameter D' being arranged.

Now the cross sectional area of the central interposer of this constitution will be calculated. The outer diameter of a circle enclosing five equivalent wire cores of outer diameter D' disposed close to each other without clearance therebetween is given as $\{1+1/\sin 36°\}\}\cdot D'=2.7\ D'$.

At this time, the outer diameter of the central interposer having circular cross section is given as (2.7−2)D'=0.7 D', and radius is 0.7 D'/2=0.35 D'. Thus cross sectional area is given as $(0.35\ D')^2\cdot\pi$.

The relationship of inequality that finds the cross sectional area S1 of the central interposer described previously was derived on the basis of the above discussion.

Figure 6:
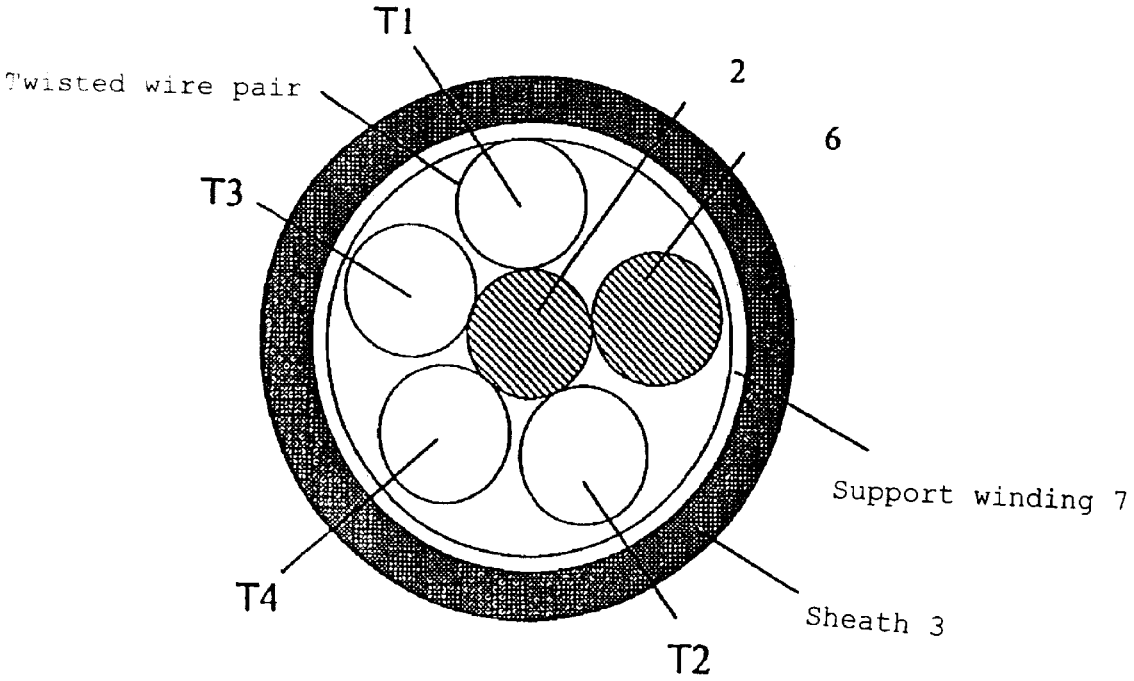
FIG. 6 is an explanatory diagram showing a communication cable according to the first embodiment of the present invention provided with an inter-pair interposer.

When the four twisted wire pairs are entwined around the central interposer having the cross sectional area S1 defined by the above relationship of inequality, clearance is generated between the twisted wire pairs. When the case of filling the clearance between the twisted wire pairs with polyolefin thermoplastic resin and the case where the clearance is left without filling are compared, it is confirmed that the effects of reducing the attenuation and reducing the propagation delay time can be achieved when the clearance is filled. As shown in FIG. 6, in the case of a 4-pair cable consisting of the four twisted wire pairs T1, T2, T3, T4 (pitches: P1<P2<P3<P4) according to the embodiment of the first form of the present invention, the largest attenuation occurs in the twisted wire pair T1 of the least twist pitch P1 and the least attenuation occurs in the twisted wire pair T4 of the largest twist pitch P4. Similarly, propagation delay time is largest in T1 and smallest in T4.

The difference in delay time of the cable as a whole is calculated from the difference between the measured values of T1 and T4.

Figure 7:
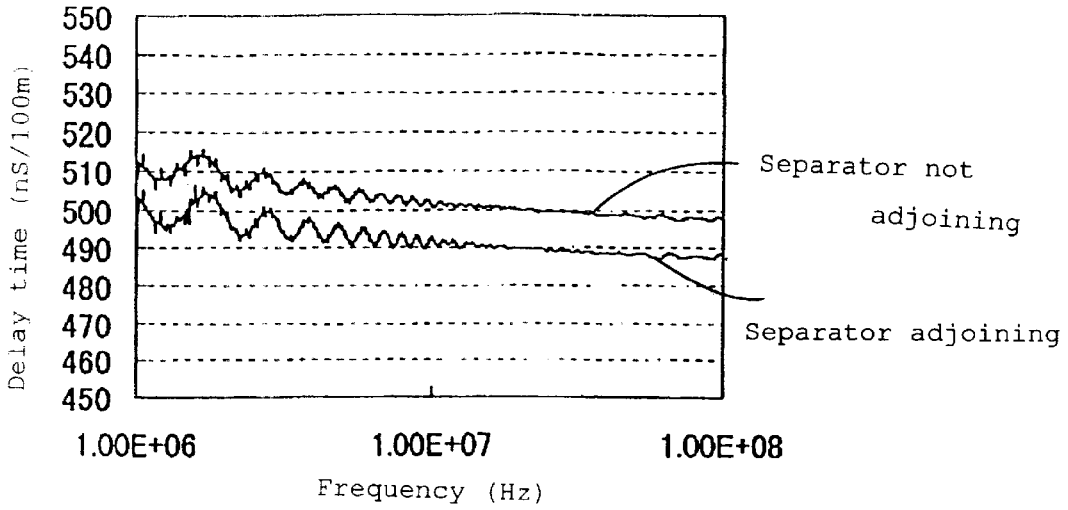
FIG. 7 is a characteristic diagram showing the difference in delay time between twisted wire pairs in the communication cable of the present invention provided with an inter-pair interposer and a communication cable without the inter-pair interposer.

FIG. 7 shows the values of delay time of 100 m cable measured in a frequency range from 1 MHz to 100 MHz in the case where an inter-pair interposer 6 is disposed adjacent to T1 as shown in FIG. 6 and a case where the interposer does not adjoin. It can be verified from this result that disposing the adjoining inter-pair interposer 6 has the effect of reducing the delay time. Consequently, because the maximum value of propagation delay time of the four-pair cable as a whole can be reduced by disposing the inter-pair interposer 6 to adjoin the twisted wire pair T1 that has the least pitch P1, the difference in delay time from the twisted wire pair T4 that has the least delay time is decreased so that the difference in delay time observed as a characteristic of a communication cable can be decreased.

Figure 8:
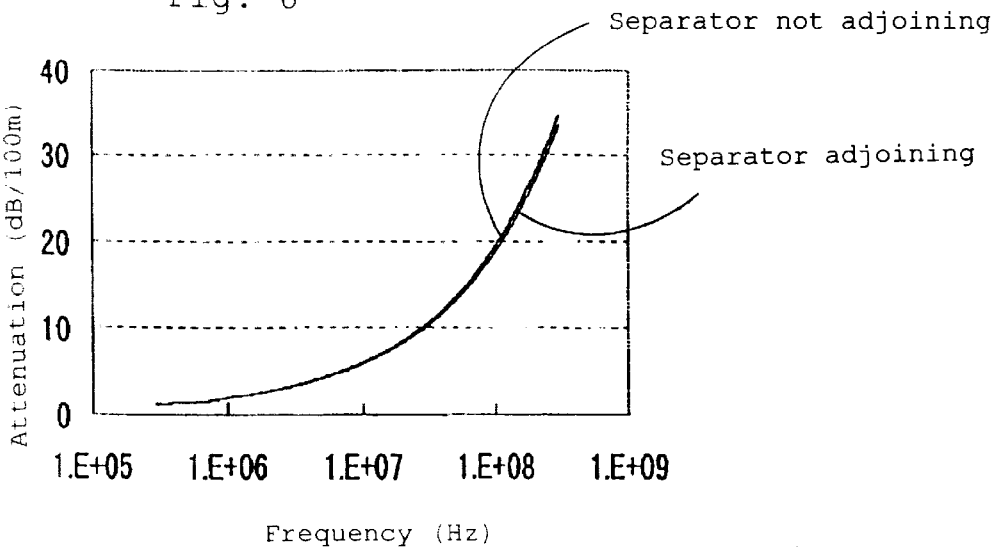
FIG. 8 is a characteristic diagram showing the attenuation by twisted wire pairs in the case of the present invention provided with an inter-pair interposer and in the case of a comparative example cable without the inter-pair interposer.

When attenuation characteristics are compared between the cases where the inter-pair interposer 6 is disposed to adjoin and the case where the interposer 6 is disposed not to adjoin, the effect of decreasing the attenuation of the twisted wire pair T1 where the inter-pair interposer 6 is disposed to adjoin can be confirmed as shown in FIG. 8. As a result, the effect of decreasing the maximum value of attenuation of the cable can be achieved.

The inter-pair interposer 6 is disposed not to adjoin the twisted wire pair T4 for the following reason. When the inter-pair interposer 6 is disposed to adjoin the twisted wire pair T4 that has the least delay time, delay time of the twisted wire pair T4 decreases further and results in a larger difference in delay time from the twisted wire pair T1. In order to avoid this, the inter-pair interposer 6 is disposed not to adjoin the twisted wire pair T4.

The center layer 2 and the outer layer 6 thereof are inserted separately one by one, not as the integral inter-pair interposer 6, for the purpose of making the inter-pair interposer 6 easier to move or deform in the cable when inserted into the modular plug, and making it easier to insert into the modular plug by flattening the twisted wire pairs and the interposer 6 as shown in FIG. 9. Reference numeral 7 denotes a support winding layer.

In this embodiment, the central interposer 2 disposed at the center and the inter-pair interposer 6 that is entwined with the twisted wire pairs around the central interposer 2 are made of thermoplastic resin in a rod-like shape, because this makes it easier to remove the interposer during the cable terminal processing than in a case such as when a commonly used thread-like interposer is employed. In this case, the rod-like interposer is preferably made of polyolefin in thermoplastic resin. As a matter of fact These interposers may also be made in a thread-like shape.

By inserting the central interposer 2 having the cross sectional area S1 defined above, space between the four twisted wire pairs increases and it is possible to decrease the cross talk even when the difference in the pitch is decreased in order to decrease the difference in delay time between the twisted wire pairs.

The inter-pair interposer 6, that fill the clearance created when the four twisted wire pairs are entwined, is made of polyolefin thermoplastic resin and is disposed to adjoin the twisted wire pair that are twisted with the least twist pitch, so that the amount of attenuation is decreased and the difference in propagation delay time among the four twisted wire pairs is also decreased. As a result, it becomes easier to terminate the cable in the modular plug than a cable that has the twisted wire pairs being separated by the cross-shaped interposer.

EMBODIMENTS

A 4-pair cable was made by twisting twisted wire pairs, that were each formed by twisting two insulated wires (diameter 0.96 mm) covered by a polyolefin in based plastic material, with an electrically conductive rod-shaped material (diameter 0.53 mm) with different twist pitches. The interposer to be inserted at the center was made to have a cross sectional area S in a range given by the following relationship of inequality.

$$S1 \geqq [\{4.1\ d/(1+\sqrt{2})\}\cdot 0.35]^2 \times \pi$$

In the case of the twisted wire pair formed by twisting the insulated wires having a diameter of 0. 96 mm, the diameter of the central interposer is given from the above relationship of inequality as $\{4.1\times 0.96/(1+\sqrt{2})\times 0.35=0.57$, and the cross sectional area is $(0.57)^2\times\pi=1.02$ ($mm^2$). Thus the central interposer having a cross sectional area not smaller than this value is used.

Embodiment 1

Figure 10:
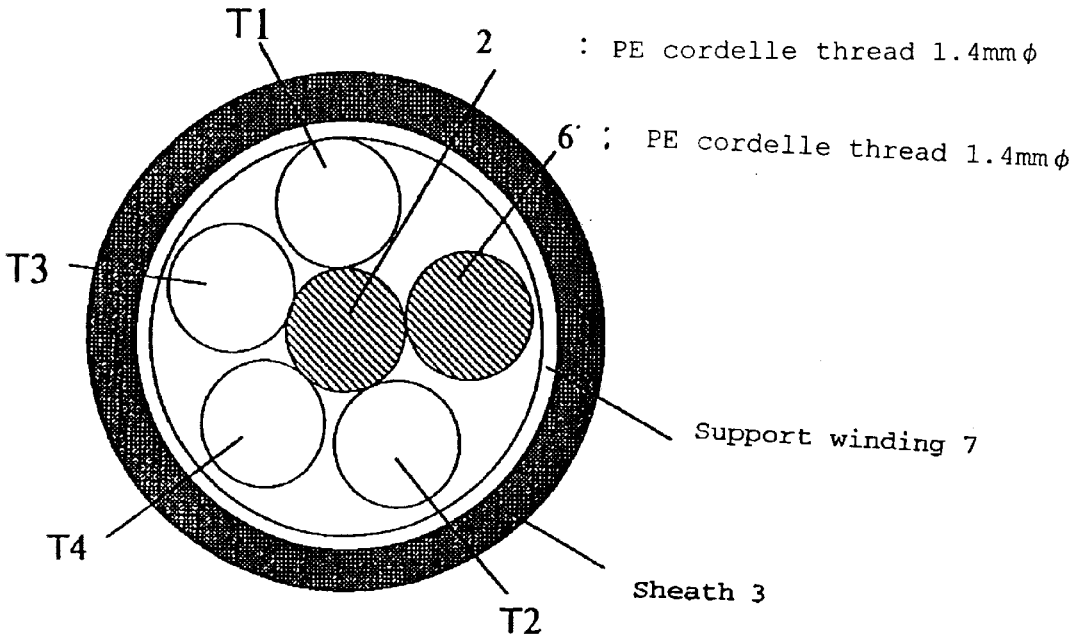
FIG. 10 is a sectional view showing the communication cable according to the first embodiment of the present invention.

The first embodiment is a case where four twisted wire pairs T1, T2, T3, T4 and the inter-pair interposer 6 made of PE in a 1.4 mm thread are entwined around the central interposer 2 made of polyolefin in a round rod of a diameter of 1.4 mm, as shown in FIG. 10. Twist pitches of the four twisted wire pairs T1, T2, T3, T4 are set to 9.9 mm (T1), 10.9 mm (T2), 14.4 mm (T3) and 23.8 mm (T4), (refer to Table 1)

TABLE 1

| | Structures of comparative example and embodiments | | | | |
|---|---|---|---|---|---|
| | Comparative example | Embodiment 1 | Embodiment 2 | Embodiment 3 | Embodiment 4 |
| Conductor | 0.53 | ← | ← | ← | ← |
| Outer diameter of insulation (mm) | 0.96–0.98 | ← | ← | ← | ← |
| Twist pitch of pair (mm) | | | | | |
| T1 | 9.9 | ← | ← | ← | ← |
| T2 | 10.9 | ← | ← | ← | ← |
| T3 | 14.4 | ← | ← | ← | ← |
| T4 | 23.8 | ← | ← | ← | ← |
| Inter poser | | | | | |

TABLE 1-continued

| | Structures of comparative example and embodiments | | | | |
|---|---|---|---|---|---|
| | Comparative example | Embodiment 1 | Embodiment 2 | Embodiment 3 | Embodiment 4 |
| Center | 0.8 mm ϕ thread | 1.4 mm ϕ thread | 1.6 mm ϕ thread | 1.8 min ϕ thread | PP yarn 11000 d |
| 1 layer | | 1.4 mm ϕ thread | 1.4 mm ϕ thread | 1.2 mm thread, 2 pcs | PP yarn 11000 d |
| Support winding | Wrapping with non-woven fabric | Wrapping with non-woven fabric | Wrapping with non-woven fabric | Wrapping with non-woven fabric | Wrapping with non-woven fabric |

At this time, the inter-pair interposer 6 made of PE thread was inserted between the twisted wire pair T1 having the least pitch and the twisted wire pair T2, and was entwined to adjoin T1.

Figure 11:
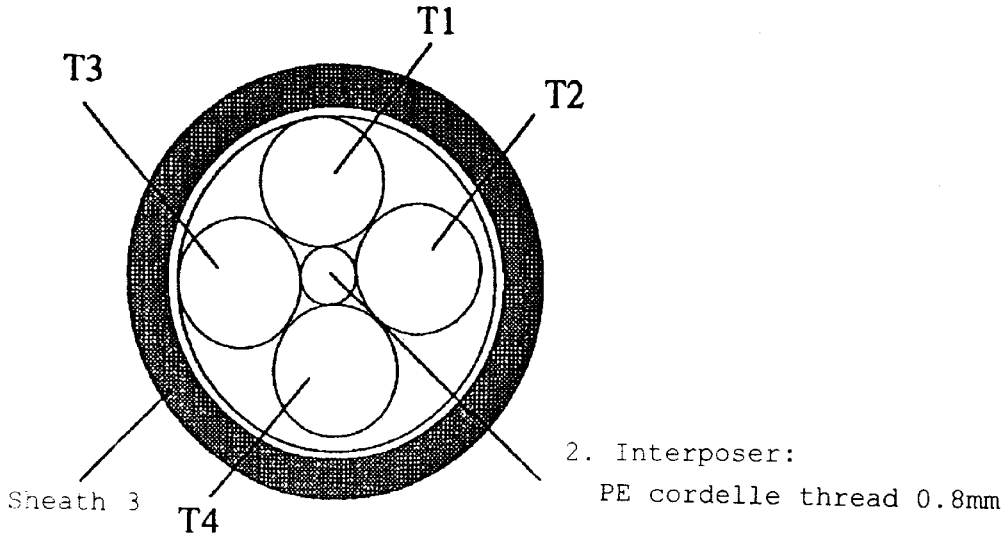
FIG. 11 is a sectional view showing a communication cable as a comparative example.
Figure 12:
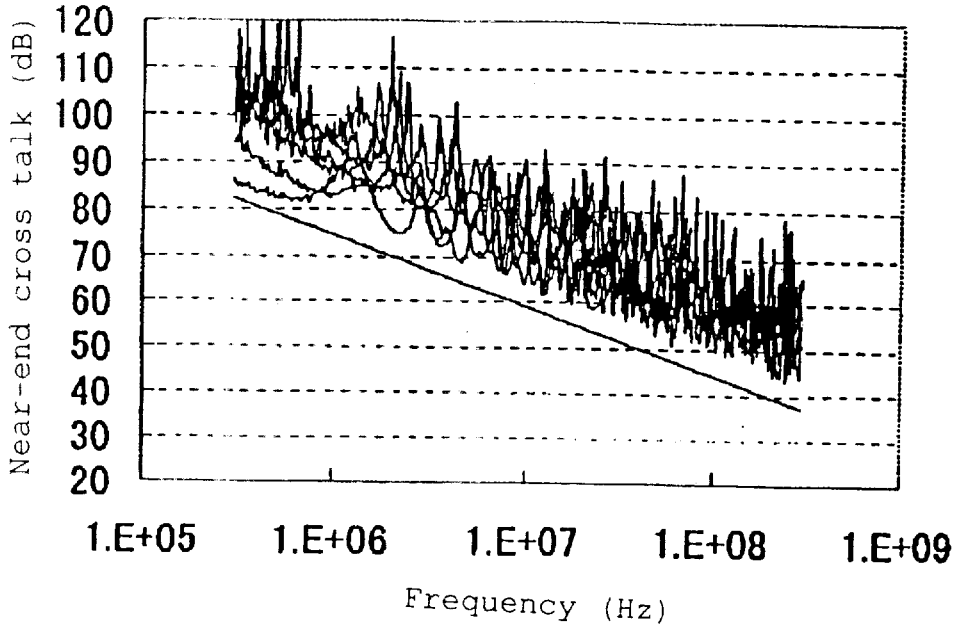
FIG. 12 is a characteristic diagram of near-end cross talk according to the first embodiment of the present invention.
Figure 13:
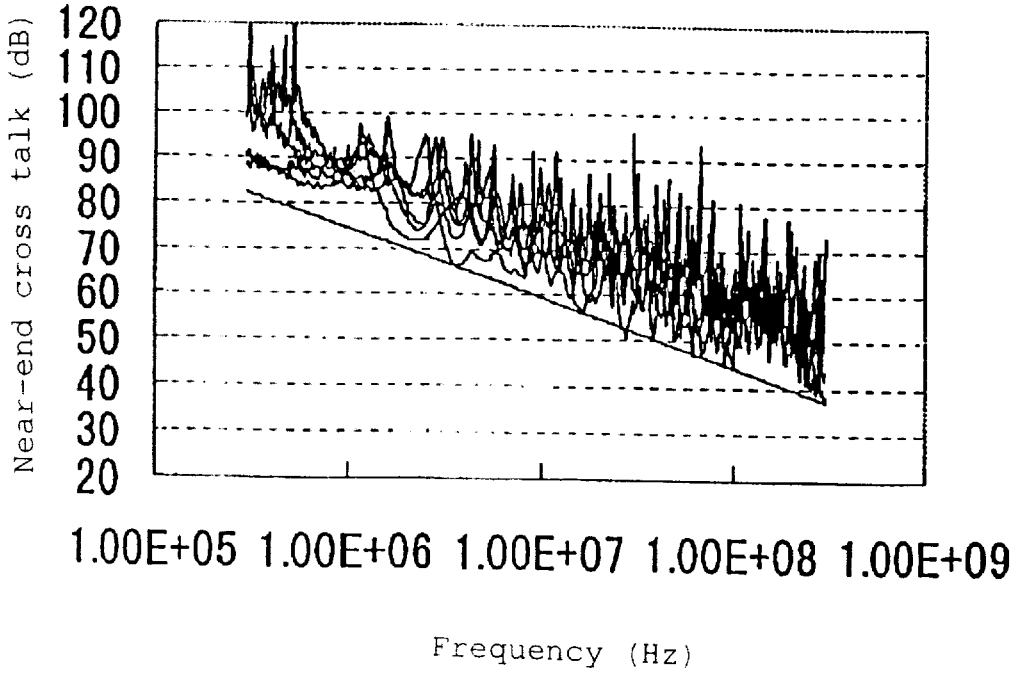
FIG. 13 is a characteristic diagram of near-end cross talk according to the comparative example.

A cable was made as a comparative example by using a central interposer 2 having diameter of 0.8 mm and entwining the twisted wire pairs having similar pitches as shown in FIG. 11. FIG. 12 and FIG. 13 show the measured values of near-end cross talk of the first embodiment and the comparative example, respectively. Each graph is a plot of the near-end cross talk measured on all (six) selected combinations of two twisted wire pairs. A straight line declining to the right in the drawing shows the characteristic requirement of the category 6 draft standard currently discussed at TIA. Measured values plotted above the straight line, which is a standard line, show compliance to the standard. The comparative example includes a combination of pairs that falls below the line, indicating less margin with respect to the standard. The embodiment, on the other hand, indicates a sufficient margin being secured with respect to the standard. Measurements of difference in delay time on cables 100 m in length showed less differences in the delay time, about 27 ns in the comparative example and about 20 ns in the comparative example.

Embodiment 2

Figure 14:
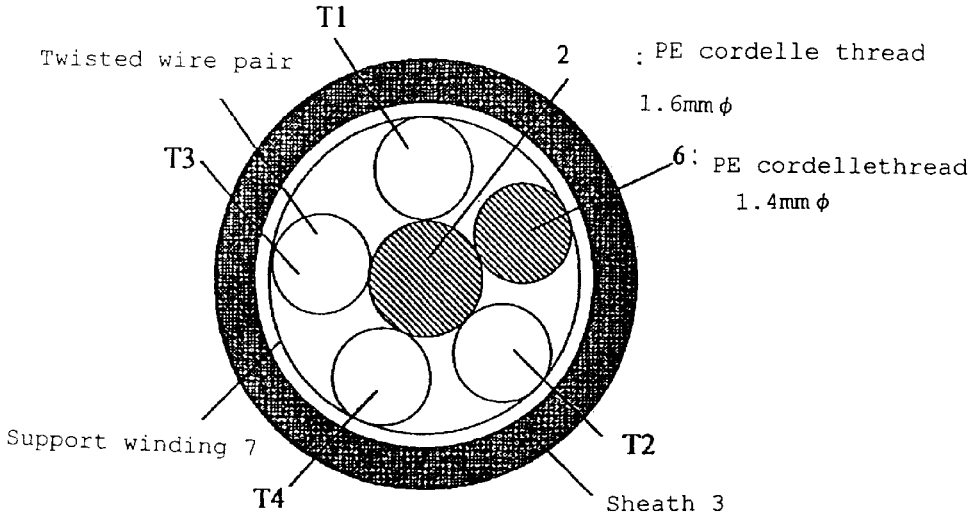
FIG. 14 is a sectional view showing a communication cable according to the second embodiment of the present invention.

The second embodiment is a case where four twisted wire pairs T1, T2, T3, T4 and the inter-pair interposer 6 made of a rod-shaped body made of polyolefin in and 1.4 mm in diameter are entwined around the central interposer 2 made in a rod-shaped body made of polyolefin in having a diameter of 1.6 mm, as shown in FIG. 14.

Embodiment 3

Figure 15:
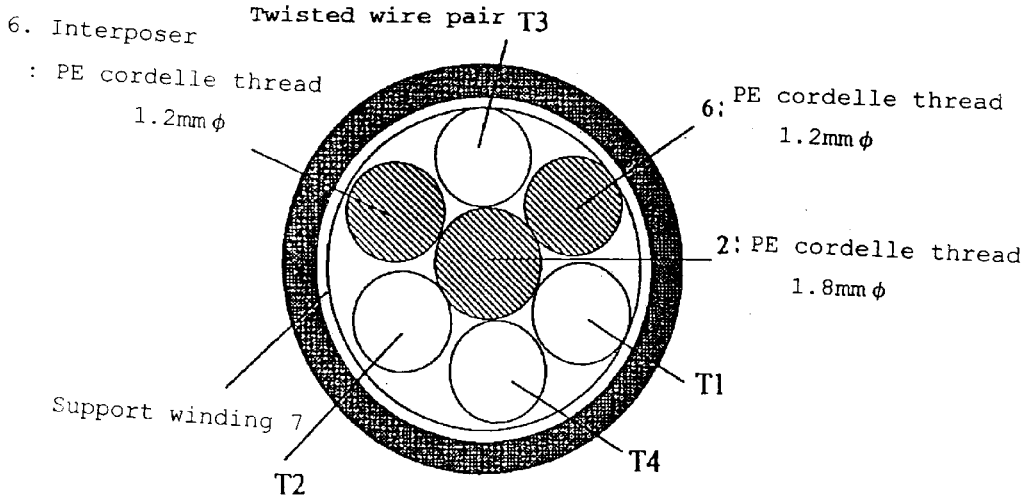
FIG. 15 is a sectional view showing a communication cable according to the third embodiment of the present invention.

The third embodiment is a case where the four twisted wire pairs T1, T2, T3, T4 and the inter-pair interposer 6 made of a rod-shaped body made of polyolefin and 1.2 mm in diameter are entwined around the central interposer 2 made in a rod-shaped body made of polyolefin in having a diameter of 1.8 mm, as shown in FIG. 15. It was confirmed that these two embodiments have effects similar to those of the first embodiment.

Embodiment 4

Figure 16:
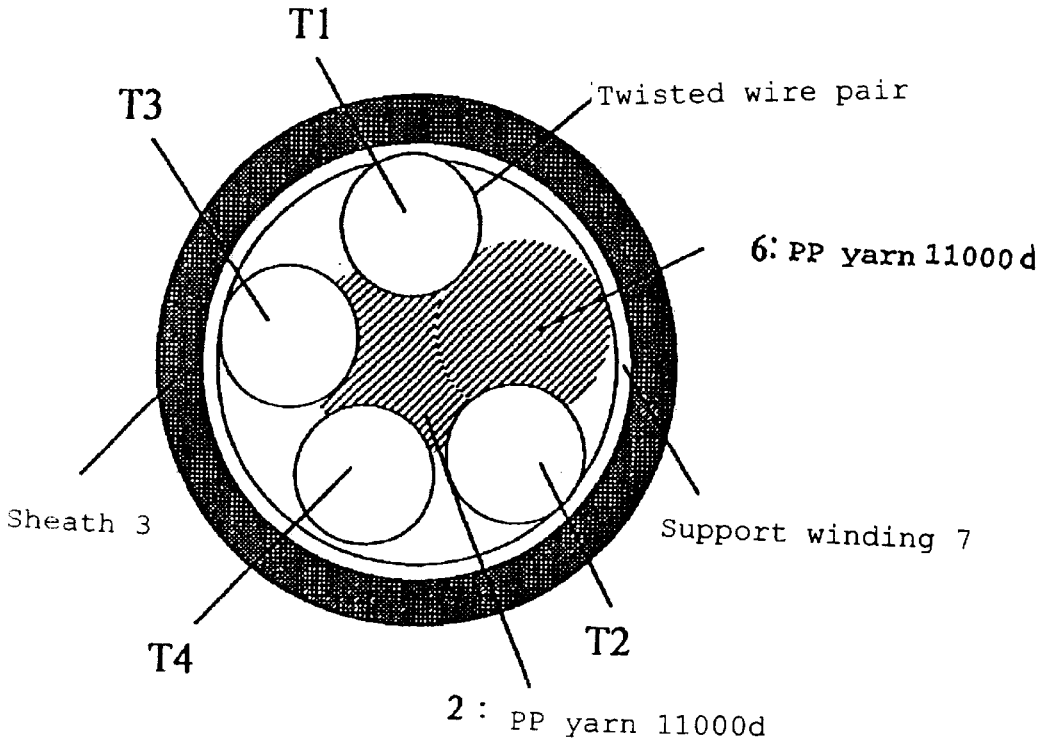
FIG. 16 is a sectional view showing a communication cable according to the fourth embodiment of the present invention.

The fourth embodiment is a case where one central interposer 2 made of PP yarn 11000d (cross sectional area 1.02 $mm^2$ or larger) is provided to fill the central interstice instead of a rod-like interposer, and one inter-pair interposer 6 made of PP yarn 11000d and four twisted wire pairs are entwined around thereof as shown in FIG. 16. A similar effect were confirmed also in this embodiment.

In any of the first through fourth embodiments, a support winding layer 7 was formed by taping around the four twisted wire pairs and the rod made of a thermoplastic material or the filler so that the arrangement thereof would not come loose, and a sheath 3 was applied thereon.

Figure 18:
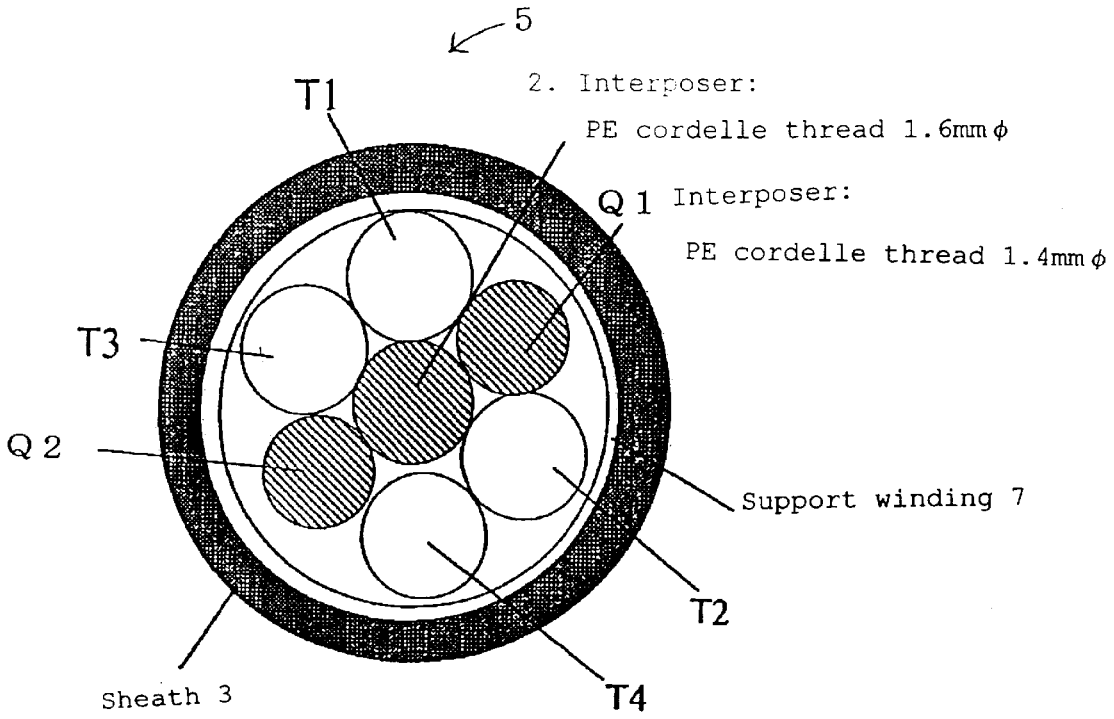
FIG. 18 is a sectional view showing the communication cable according to the fifth embodiment of the present invention.

Now the communication cable according to the embodiment of the second form of the present invention will be described below where two types of inter-pair interposers Q1, Q2 having different specific dielectric constants are used as shown in FIG. 18.

In this embodiment, the four twisted wire pairs (T1, T2, T3, T4: twist pitches: P1<P2<P3<P4) and the rod made of a thermoplastic resin are entwined with each other in an arrangement by which the twisted wire pairs are grouped in a set of T1 and T3 and a set of T2 and T4. This is for the purpose of decreasing the cross talk further by keeping the twisted wire pairs having a small difference in pitch, that is T1 and T2, T2 and T3, and T3 and T4, from making contact with each other.

The first inter-pair interposer Q1 is disposed between the central interposer 2 and the twisted wire pairs T1, T2, and is made of polyolefin thermoplastic resin. The second inter-pair interposer Q2 is disposed between the twisted wire pairs T3 and T4, and is made of polyolefin in thermoplastic resin including a metal hydrate or made of polyvinyl chloride.

Propagation delay time of the twisted wire pairs T1, T2 having small pitches P1, P2 are larger than the delay times of the twisted wire pairs T3, T4 that have large pitches P3, P4. As described previously, propagation delay time of the twisted wire pairs T1, T2 decrease when the first inter-pair interposer Q1 is disposed adjacent thereto. On the other hand, since the interposer made of polyolefin thermoplastic resin including a metal hydrate or made of polyvinyl chloride has higher specific dielectric constant than the interposer made of a simple polyolefin material, delay times in the twisted wire pairs T3 and T4 increase (the central interposer 2 is made of a simple polyolefin resin material at this time).

As a result, since the delay time in the twisted wire pair T1 decreases and the delay time in the twisted wire pair T4 increases due to having the values of the specific dielectric constants, the difference in propagation delay time of the 4-pair cable as a whole can be decreased. Specifically, the first inter-pair interposer Q1 is disposed adjacent to the twisted wire pair T1 that has the largest propagation delay time due to having the least twist pitch P1, thereby adjusting the propagation delay time thereof to decrease, and the second inter-pair interposer Q2 is disposed adjacent to the twisted wire pair T4 that has the least propagation delay time due to the largest twist pitch P4 thereby adjusting the propagation delay time thereof to increase, so that the difference in propagation delay time of the 4-pair cable as a whole decreases.

Figure 17:
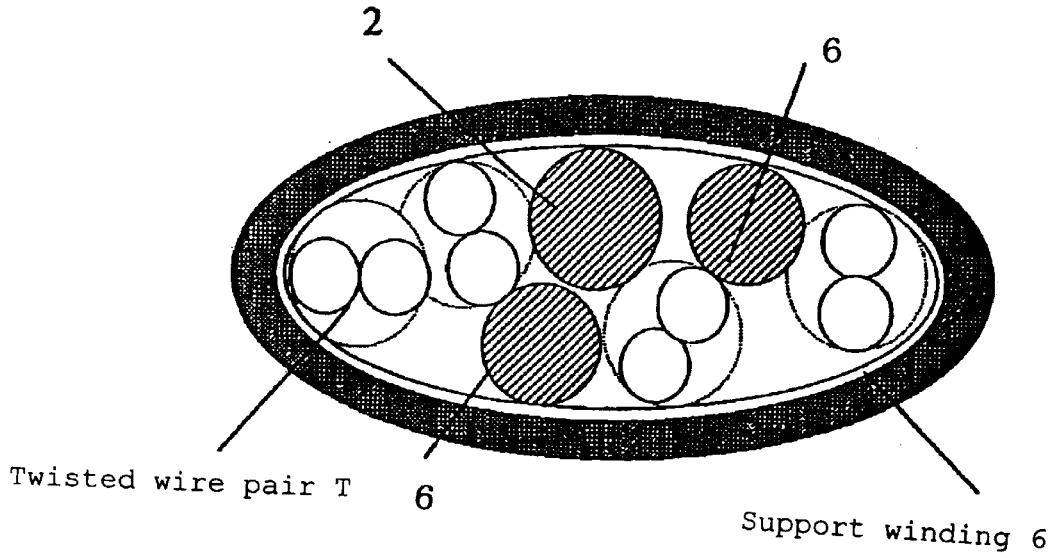
FIG. 17 is a sectional view showing a flattened end of communication cable according to the fifth embodiment of the present invention.

The center layer 2 and the interposers Q1, Q2 of the outer layer thereof are inserted separately one by one, not as an integral interposer, for the purpose of making the interposers easier to move or deform in the cable when inserted into the modular plug, and making it easier to insert into the modular plug by flattening as shown in FIG. 17.

In this embodiment, too, cross talk can be decreased even when the difference in the pitch is decreased in order to decrease the difference in delay time between the twisted wire pairs by inserting the central interposer 2 having the cross sectional area S1 defined above thereby increasing the space between the four twisted wire pairs.

Also cross talk generated in one twisted wire pair by the other three pairs can be decreased by separating the four twisted wire pairs into groups each consisting of two pairs by the two inter-pair interposers Q1, Q2 that are entwined with the four twisted wire pairs and the central interposer 2. Also when the four twisted wire pairs T1, T2, T3, T4 (pitches: P1<P2<P3<P4) are divided into groups of two twisted wire pairs (T1, T3) and (T2, T4), a configuration is achieved such that the interposer is provided between every combination of twisted wire pairs, T1 and T2, T2 and T3, and T3 and T4, thereby decreasing the cross talk further.

When the second inter-pair interposer Q2, made of polyolefin thermoplastic resin with a metal hydrate added thereto in order to fireproof it or made of polyvinyl chloride, is used and inserted as an inter-pair interposer to fill in addition to the first inter-pair interposer Q1 made of polyolefin thermoplastic resin. When the first inter-pair interposer Q1 made of polyolefin thermoplastic resin is disposed to adjoin the twisted wire pair T1 that is twisted with the least pitch P1 and the second inter-pair interposer Q2 made of polyolefin thermoplastic resin including a metal hydrate added thereto or made of polyvinyl chloride is disposed to adjoin the twisted wire pair T4 that is twisted with the largest pitch P4 during insertion, propagation delay time of the twisted wire pair T1 decreases and propagation delay time of the twisted wire pair T4 increases, so that the difference in propagation delay time between the four twisted wire pairs that is determined by T1–T4 also decreases.

Since the three interposers that are inserted are not made in a single body, the cable flattens more easily and it is easier to process cable terminal in the modular plug, than with a cable wherein the twisted wire pairs are separated by an integral cross-shaped interposer.

Now more specific embodiments of the communication cable employing the two types of inter-pair interposers Q1, Q2 will be described below.

EMBODIMENTS

A 4-pair cable was made by entwining twisted wire pairs, that were each formed by twisting two insulated wires (diameter 0.96 mm) covered by a polyolefin based plastic material, and an electrically conductive rod-shaped material (diameter 0.53 mm) with different twist pitches. The interposer to be inserted at the center was made to have a cross sectional area S that satisfies the following relationship of inequality.

$$S1 \geqq [\{4.1\ d/(1+\sqrt{2})\}\cdot 0.35]^2 \times \pi$$

In the case of the twisted wire pair formed by twisting the insulated wire having a diameter of 0.96 mm, the diameter of the central interposer is given from the above relationship of inequality as $\{4.1\times 0.96/(1+\sqrt{2})\times 0.35=0.57$, and the cross sectional area is $(0.57)^2\times\pi=1.02$ ($mm^2$). Thus the central interposer having a cross sectional area not smaller than this value is used.

Embodiment 4

The fourth embodiment is a case where four twisted wire pairs T1, T2, T3, T4 and two inter-pair interposers Q1, Q2 made of PE thread and 1.4 mm in diameter are twisted around the central interposer 2 made of polyolefin in a round rod having a diameter of 1.5 mm thereby constituting a communication cable 5, as shown in FIG. 18. Pitches of the four twisted wire pairs are set to 9.9 mm (T1), 10.9 mm (T2), 14.4 mm (T3) and 21.4 mm (T4), as shown in Table 2.

The inter-pair interposers Q1, Q2 were entwined so as to adjoin the twisted wire pair T1 and the twisted wire pair T2 therebetween and adjoin the twisted wire pair T3 and the twisted wire pair T4 therebetween. Consequently, only T1, T3 and T2, T4 are the combinations of twisted wire pairs that adjoin each other.

TABLE 2

| | embodiment 4 | embodiment 5 |
|---|---|---|
| conductor(mm) | 0.53 | ← |
| outer diameter of insulation (mm) | 0.96–0.98 | ← |
| twist pitch of pair (mm) | | |
| T1 | 9.9 | ← |
| T2 | 10.9 | ← |
| T3 | 14.4 | ← |
| T4 | 21.4 | ← |
| inter poser | | |
| center | 1.6 mm φ thread (polyethylene) | 1.6 mm φ thread (polyethylene) |
| 1 layer: between T1 and T2, between T3 and T4 | 1.4 mm φ thread (polyethylene) 1.4 mm φ thread (polyethylene) | 1.4 mm φ thread (polyethylene) 1.4 mm φ thread (polyvinyl chloride) |
| support winding | wrapping with non-woven fabric | wrapping with nonwoven fabric |

Figure 19:
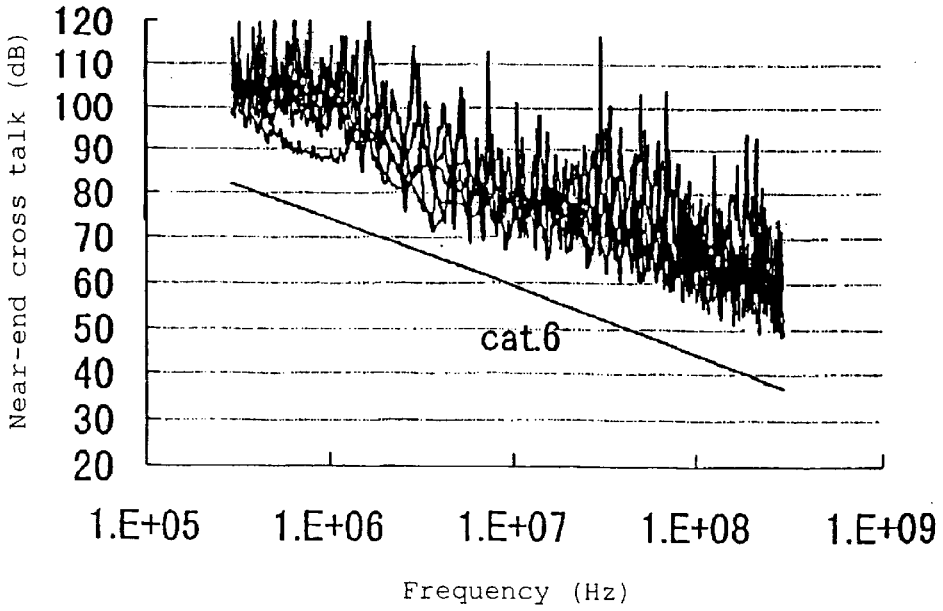
FIG. 19 is a characteristic diagram of near-end cross talk according to the fifth embodiment of the present invention.

FIG. 19 shows the measured values of near-end cross talk of the fourth embodiment. The graph shows the near-end cross talk measured in all (six) selected combinations of two twisted wire pairs plotted together. A straight line declining to the right in FIG. 19 shows the characteristic requirement of the category 6 draft standard currently discussed at TIA.

Measured values plotted above the straight line show that the goal is achieved. Thus it can be seen that the fourth embodiment ensures a sufficient margin being secured with respect to the standard.

Embodiment 5

Figure 20:
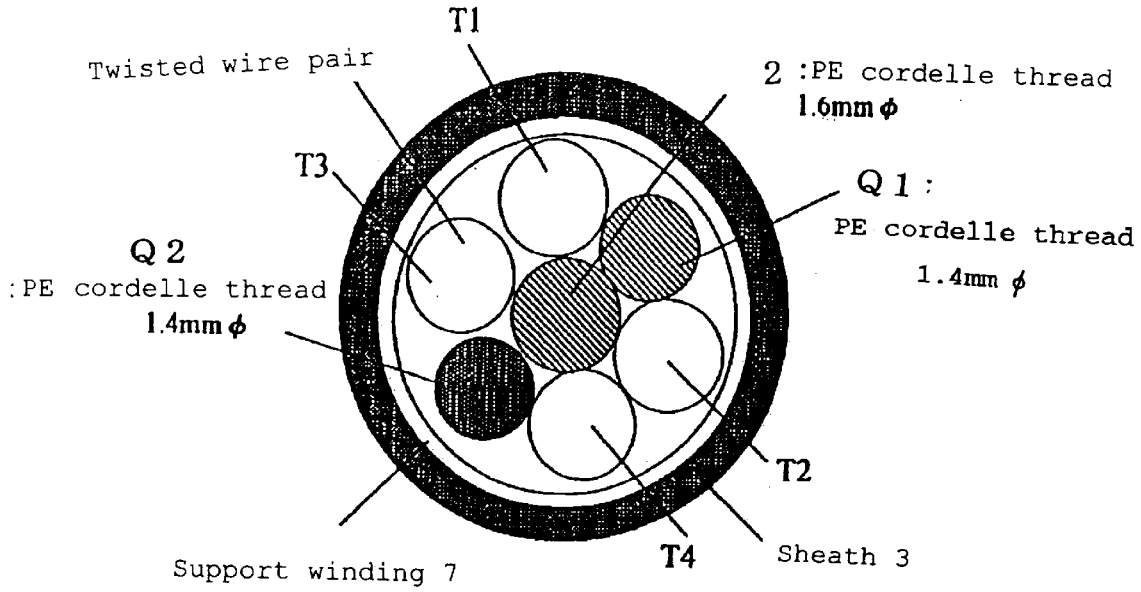
FIG. 20 is a sectional view showing a communication cable according to the sixth embodiment of the present invention.

The fifth embodiment is a case using a 1.6 mm in diameter rod-shaped body made of polyolefin, a 1.4 mm in diameter rod-shaped body made of polyolefin and a 1.4 mm in diameter rod-shaped body made of polyvinyl chloride (PVC) as interposers that separate the twisted wire pairs T1, T3 and T2, T4, as shown in FIG. 20. The 1.6 mm in diameter rod-shaped body made of polyolefin was used as the central interposer 2, the 1.4 mm in diameter rod-shaped body made of polyolefin was used as the first inter-pair interposer Q1 installed between the twisted wire pairs T1 and T2, and the 1.4 mm in diameter rod-shaped body made of polyvinyl chloride was used as the second inter-pair interposer Q2 installed between the twisted wire pairs T3 and T4. In this case, since the propagation delay time in the twisted wire pairs T3 and T4 becomes longer than in the case of the fourth embodiment due to the specific dielectric constant, differences between the delay time of the twisted wire pair T1 and the delay time of the twisted wire pair T4 decrease (25 ns/100 m in the fourth embodiment, and 20 ns/100 m in the fifth embodiment). The effect that the difference between the delay time of the twisted wire pair T1 and the delay time of the twisted wire pair T4 decreases was confirmed also in a case where a rod-shaped body (1.4 mm ϕ) made of polyolefin in mixed with aluminum hydroxide was used instead of the interposer made of PVC (the second inter-pair interposer Q2) of the fifth embodiment.

The sheath 3 in the first through fifth embodiments was made of PVC. When the case of applying the PVC jacket directly on the four twisted wire pairs that have been entwined and the case of covering the four twisted wire pairs that have been entwined with polyethylene and applying the PVC jacket thereon are compared, attenuation is larger in the former case. Therefore, when PVC is used for the jacket as in the embodiments, it is preferable to provide a support winding by wrapping with a polyethylene tape or non-woven fabric or other fabric impregnated with air under the jacket layer, or to apply the jacket made of a thermoplastic resin after covering the wires with a polyolefin thermoplastic resin by extrusion molding.

When directly applying the jacket while considering noncombustibility, polyolefin thermoplastic resin with a fireproof agent such as magnesium hydroxide or aluminum hydroxide added thereto is used.

Now an embodiment of the multiple-pair communication cable made by bundling a plurality of communication cables of the embodiments described above will be described below.

Figure 22:
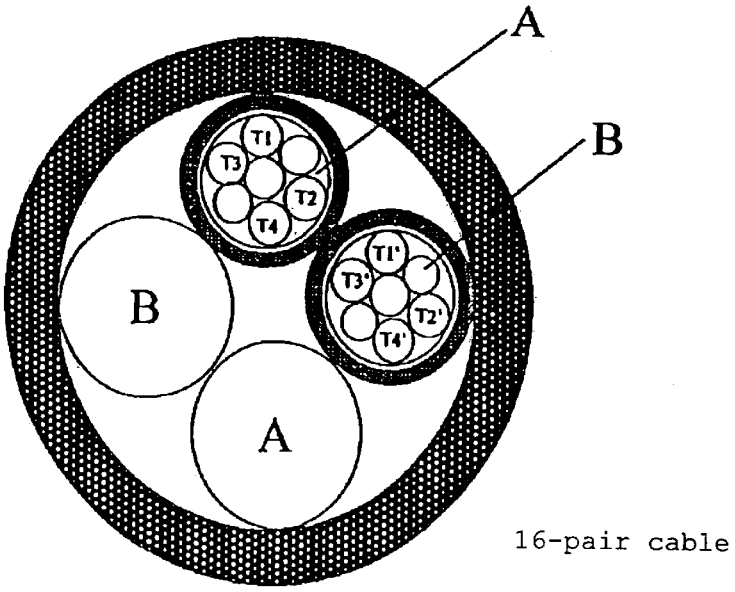
FIG. 22 is a sectional view showing another embodiment of the multiple-pair communication cable according to the present invention.
Figure 21A:
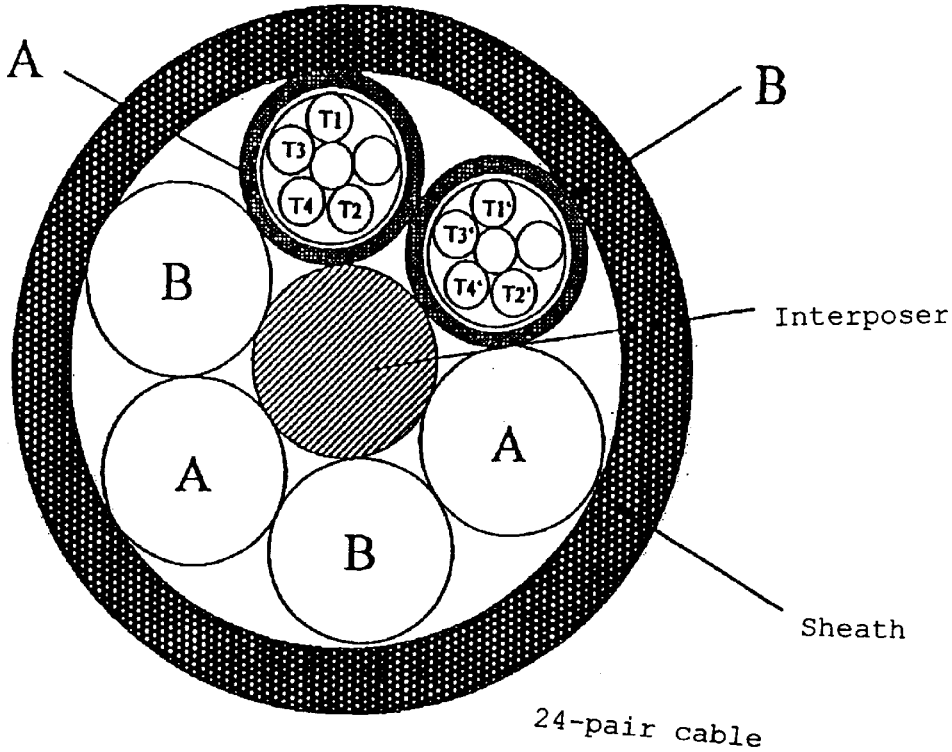
FIG. 21A, FIG. 21B are sectional views showing an embodiment of a multiple-pair communication cable according to the present invention.
Figure 21B:
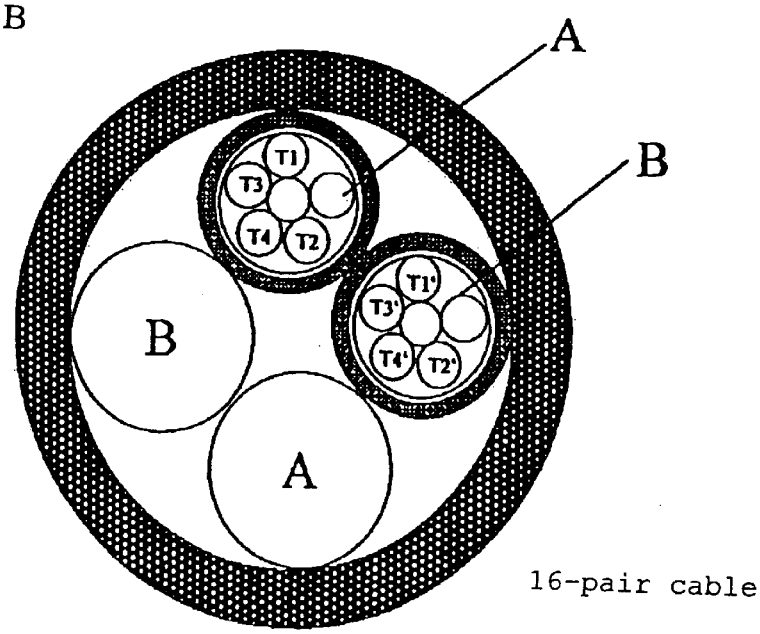

A plurality of the 4-pair communication cables of the present invention may be bundled to form a multiple-pair cable as shown in FIG. 21A, FIG. 21B and FIG. 22. The example shown in FIG. 21A is a 24-pair communication cable made by bundling six 4-pair communication cables around the central interposer, and the examples shown in FIG. 21B and FIG. 22 are 16-pair communication cables made by bundling four 4-pair communication cables.

In these cases, when the twist pitches of the four twisted wire pairs (T1, T2, T3, T4) that constitute any one 4-pair communication cable A among the plurality of 4-pair communication cables that are bundled are set to P1<P2<P3<P4, it is desirable to set the twist pitches (P1'<P2'<P3'<P4') of the four twisted wire pairs (T1', T2', T3', T4') of the 4-pair communication cable B that adjoin the 4-pair cable so as to be P1≠P2≠P3≠P4≠P1'≠P2'≠P3'≠P4', namely so that twist pitches of all of the twist pairs are different from each other, in order to decrease the cross talk.

What is claimed is:

1. A communication cable comprising a central interposer having cross sectional area S1, four twisted wire pairs T1, T2, T3 and T4 made by twisting pairs of insulated wires each made by covering an electrically conductive wire with an insulating material, each pair being twisted with a twist pitch different from the others, and one or more inter-pair interposers, wherein said four twisted wire pairs and said one or more inter-pair interposers are disposed around said central interposer while being entwined with each other, pitch P1 of said twisted wire pair T1, pitch P2 of said twisted wire pair T2, pitch P3 of said twisted wire pair T3 and pitch P4 of said twisted wire pair T4 are set to satisfy a relationship of inequality P1<P2<P3<P4, a diameter d of each insulated wire that constitutes the twisted wire pairs and said cross sectional area S1 of the central interposer are set to satisfy the relationship of inequality $$S1 \geqq [\{4.1\ d/(1+\sqrt{2})\}\cdot 0.35]^2 \times \pi$$

while the one or more inter-pair interposers that is or are entwined with said twisted wire pairs is or are located at such a position as adjoins the twisted wire pair T1 having the least pitch P1 with a specific dielectric constant that decreases the propagation delay time of the adjoining twisted wire pair T2 and does not adjoin the twisted wire pair T4 having the largest pitch P4.

2. A communication cable as described in claim 1 wherein the central interposer, the one or more inter-pair interposers and the insulator of the insulated wires are all made of polyolefin thermoplastic resin.

3. A multiple-pair communication cable constituted by bundling a plurality of the communication cables as described in claim 2.

4. A communication cable as described in claim 1 wherein the central interposer and the one or more inter-pair interposers are made of a thermoplastic resin in a rod shape, and the central interposer has a circular cross section.

5. A multiple-pair communication cable constituted by bundling a plurality of the communication cables as described in claim 4.

6. A multiple-pair communication cable constituted by bundling a plurality of the communication cables as described in claim 1.

7. A communication cable comprising a central interposer having cross sectional area of S1, four twisted wire pairs T1, T2, T3, T4 made by twisting pairs of insulated wires each made by covering an electrically conductive wire with an insulating material, each pair being twisted with a twist pitch different from the others, and two inter-pair interposers, first inter-pair interposer Q1 and second inter-pair interposer Q2, wherein said four twisted wire pairs and said two inter-pair interposers are disposed around said central interposer while being entwined with each other, pitch P1 of said twisted wire pair T1, pitch P2 of the twisted wire pair T2, pitch P3 of the twisted wire pair T3 and pitch P4 of the twisted wire pair T4 are set to satisfy a relationship of inequality P1<P2<P3<P4, a diameter d of each insulated wire that constitutes the twisted wire pairs and said cross sectional area S1 of the central interposer satisfy the relationship of inequality $$S1 \geqq [\{4.1\ d/(1+\sqrt{2})\}\cdot 0.35]^2 \times \pi$$

while said first inter-pair interposer Q1 is disposed to adjoin the twisted wire pair T1 having the least pitch P1 with a specific dielectric constant that decreases the propagation delay time of the adjoining twisted wire pair T1, said second inter-pair interposer Q2 is disposed to adjoin the twisted wire pair T4 having the largest pitch P4 with a specific dielectric constant that increases the propagation delay time of the adjoining twisted wire pair T4, the twisted wire pair T1 having the least pitch P1 is located at such a position that does not adjoin the twisted wire pair T4 having the largest pitch P4 and said second inter-pair interposer Q2, and the twisted wire pair T4 having the largest pitch P4 is located at such a position that does not adjoin the twisted wire pair T1 having the least pitch P1 and said first inter-pair interposer Q1.

8. A communication cable as described in claim 7 wherein the twisted wire pair T1, the first inter-pair interposer Q1, the twisted wire pair T2, the twisted wire pair T4, the second inter-pair interposer Q2 and the twisted wire pair T3 are disposed around the central interposer in this order, with a set of the twisted wire pair T1 and the twisted wire pair T3 and a set of the twisted wire pair T2 and the twisted wire pair T4 being entwined with each other while being separated from each other by the inter-pair interposers Q1, Q2.

9. A communication cable as described in claim 8 wherein the central interposer and the insulator of the insulated wires are made of a polyolefin thermoplastic resin, said each electrically conductive wire is made of soft copper wire, the first inter-pair interposer Q1 is made of polyolefin thermoplastic resin, and the second inter-pair interposer Q2 is made of polyolefin thermoplastic resin including a metal hydrate or made of polyvinyl chloride.

10. A multiple-pair communication cable constituted by bundling a plurality of the communication cables as described in claim 9.

11. A multiple-pair communication cable constituted by bundling a plurality of the communication cables as described in claim 8.

12. A communication cable as described in claim 7 wherein the central interposer and the insulator of the insulated wires are made of a polyolefin thermoplastic resin, said each electrically conductive wire is made of soft copper wire, the first inter-pair interposer Q1 is made of polyolefin thermoplastic resin, and the second inter-pair interposer Q2 is made of polyolefin thermoplastic resin including a metal hydrate or made of polyvinyl chloride.

13. A multiple-pair communication cable constituted by bundling a plurality of the communication cables as described in claim 12.

14. A communication cable as described in claim 7 wherein the central interposer has a circular cross section.

15. A multiple-pair communication cable constituted by bundling a plurality of the communication cables as described in claim 14.

16. A multiple-pair communication cable constituted by bundling a plurality of the communication cables as described in claim 7.

* * * * *